US005722114A

United States Patent [19]

Lapp, Jr. et al.

[11] Patent Number: 5,722,114

[45] Date of Patent: Mar. 3, 1998

[54] GATE CLOSURE MECHANISM

[75] Inventors: John K. Lapp, Jr., New Holland; Christian A. Stoltzfus, Bird-In-Hand; Joseph P. Wachter, Nancaster, all of Pa.

[73] Assignee: Quality Fencing & Supply Co., New Holland, Pa.

[21] Appl. No.: 719,435

[22] Filed: Sep. 25, 1996

[51] Int. Cl.[6] ..... E05F 1/08

[52] U.S. Cl. ..... 16/78; 16/61; 16/286

[58] Field of Search ..... 16/286, 78, 72, 16/76, 61, 63

[56] References Cited

U.S. PATENT DOCUMENTS

| | | | |
|---|---|---|---|
| 228,856 | 6/1880 | Bauman | 16/78 |
| 580,876 | 4/1897 | Lorton | 16/72 |
| 842,121 | 1/1907 | Smith | 16/63 |
| 1,834,609 | 12/1931 | Fitts | 16/78 |
| 4,649,597 | 3/1987 | Cacicedo | 16/76 |
| 4,991,256 | 2/1991 | Jeynes et al. | 16/61 |

FOREIGN PATENT DOCUMENTS

| | | | |
|---|---|---|---|
| 24994 | of 1910 | United Kingdom | 16/78 |

*Primary Examiner*—Chuck Y. Mah
*Attorney, Agent, or Firm*—William B. Noll

[57] ABSTRACT

Invention is directed to a compression spring mechanism, particularly in combination with a fencing system which incorporates a swinging gate. The mechanism, intended to automatically close a released and opened gate, comprises a cylindrical tube, mounted within the gate, a plurality of compression springs aligned end-to-end within the tube, and a spring housing secured to one end of the tube for receiving one of the compression springs. A cable, of predetermined length, passes through the housing and aligned springs and is secured to the spring end most remote from the spring housing. The other end of the cable is secured to a stationary member, such as a post about which the gate pivots. As the gate is opened, the springs are further compressed storing sufficient energy to allow closure of the gate when released.

11 Claims, 3 Drawing Sheets

14
18
16
10
14
20
20
22
16

20
14
14
20
16
46
56

14
16
20
14
20
46
56

GATE CLOSURE MECHANISM

BACKGROUND OF THE INVENTION

This invention is directed primarily to a compression spring mechanism that is useful as a self closing means for a swinging gate, particularly a vinyl or PVC type fencing system where the components thereof are formed and shaped from hollow tubular members.

Historically compression springs, exteriorly mounted, have been employed as a closing means for swinging gates and doors. One difficulty associated with such a system is the arcuate limit or extent by which the gate or door may be opened. Generally such limit is less than 90 degrees, which often my be adequate. However, to exceed this limit will damage the system by over extending the spring. In such cases, closure will not be completed. Even without exceeding the opening limit, the environmental elements, such as moisture and extreme temperatures can cause the spring to deteriorate and lose its effectiveness.

A more recent system, particularly as a gate closure, utilizes a more massive compression spring, one end of which is mounted to a gate post and the other end to a stationary fence post about which the gate closure pivots. In this prior art system as the gate opens, or pivots, the compression spring is further compressed to effect a build-up of energy for self closing of the gate, upon the gate's release.

Each of these systems suffer a number of limitations—limits on opening the gate or door, and exposure to the environment. The present invention avoids such limitations by the use of a unique internally mounted compression spring mechanism that permits pivoting a gate, for example, up to 180 degrees without overstressing the mechanism. The manner by which these attributes are realized will become apparent in the description which follows, particularly when read in conjunction with the accompanying drawings.

SUMMARY OF THE INVENTION

This invention relates preferably to a compression spring mechanism that is particularly useful as a self closing means for a swinging gate. A preferred embodiment of the invention includes a fence system formed and shaped from hollow PVC members, where a swinging gate therefor is characterized by at least a movable hollow post and at least a stationary post about which the hollow post pivots. The compression spring mechanism comprises a cylindrical tube, a plurality of compression springs aligned end-to-end within the tube, and a spring housing secured to one end of the tube for receiving one of the compression springs. A cable passes through the aligned springs and extends through the spring housing for mounting to the stationary post. The opposite end of the wire is secured to the remote end of the spring proximate the top of the cylindrical tube. The spring mechanism is secured within the hollow post of the gate. As the hollow post is pivoted about the stationary post, the cable is pulled along the cylindrical tube toward and exiting the spring housing. By this action the plural springs are further compressed, thus building up energy to be released during closing of the gate.

DETAILED DESCRIPTION OF PREFERRED EMBODIMENT

This invention relates to a self-closing compression spring mechanism that is particularly suited as a gate closure for vinyl or PVC type fencing systems.

Figure 1:
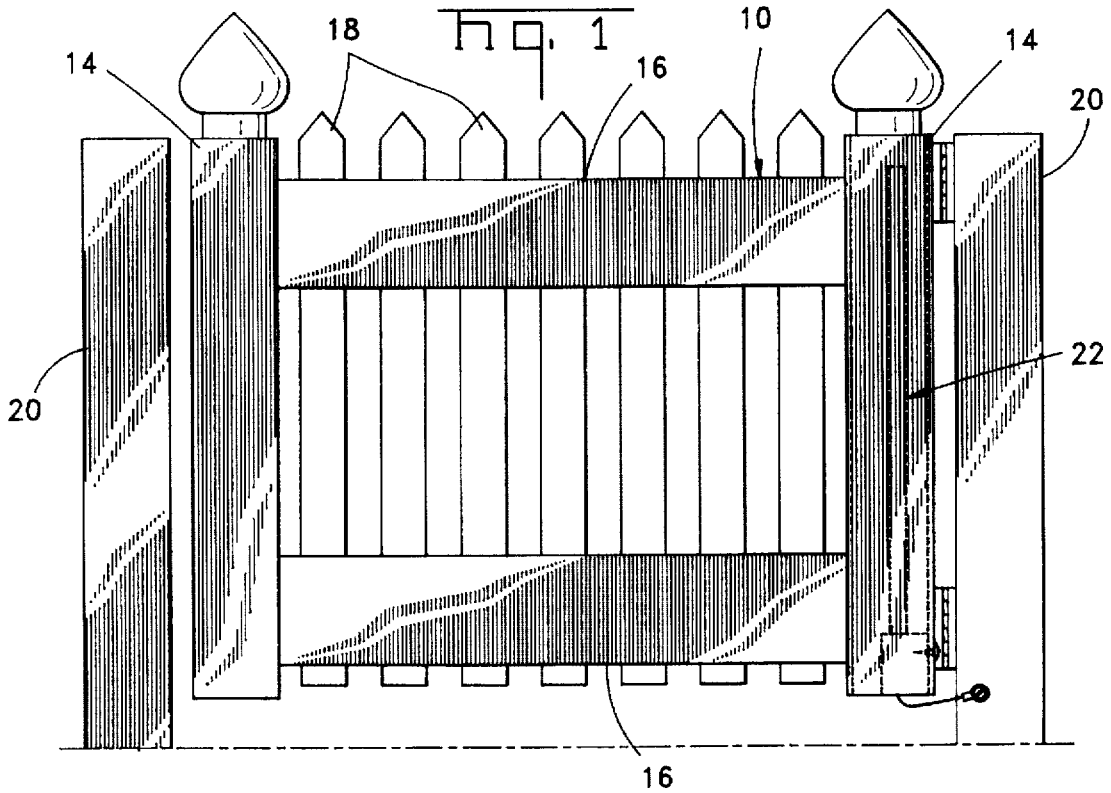
FIG. 1 is a plan view of a swinging gate for a fence system that utilizes the gate closure mechanism according to this invention.

FIG. 1 illustrates such a system, especially the swinging gate 10, where the gate typically comprises a pair of generally hollow posts 14, preferably formed and shaped from PVC, a pair of horizontally disposed support members 16, and plural pickets 18 mounted thereon. One such feature of all fencing systems with a swinging gate is a stationary post 20 to which one hollow post 14 is hingedly mounted. Typically, a second spaced apart post may be provided to which the second hollow post 14 is latchedly secured. In any case, the preferred embodiment hereof typically includes a hollow stationary post, generally 4×4 inches in cross section, though a solid stationary post may be utilized with the self-closing compression spring mechanism of this invention.

Figure 2:
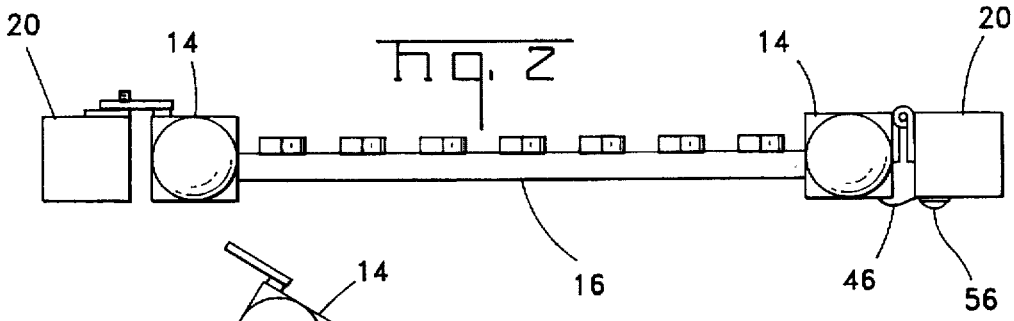
FIG. 2 is a top view of the swinging gate of FIG. 1, in a normal or closed position.
Figure 3:
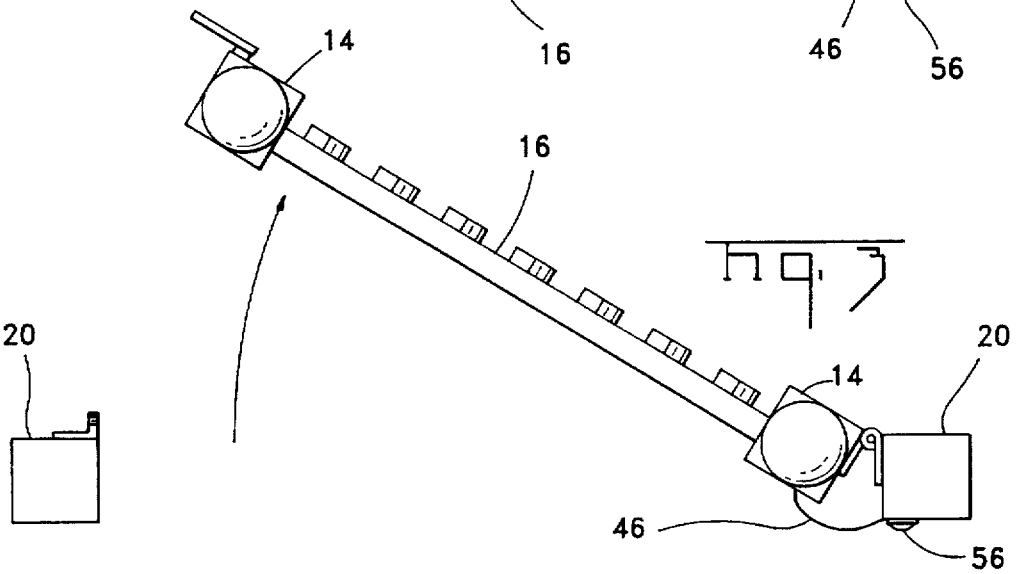
FIG. 3 is a top view, similar to FIG. 2, but showing the swinging gate in an opened position.

FIGS. 2 and 3 represent, respectively, the closed position and a typical opened position or the swinging gate. A further feature of this invention is the ability of the gate to pivot up to about 180 degrees without affecting the closure mechanism, as hereafter described.

Figure 4:
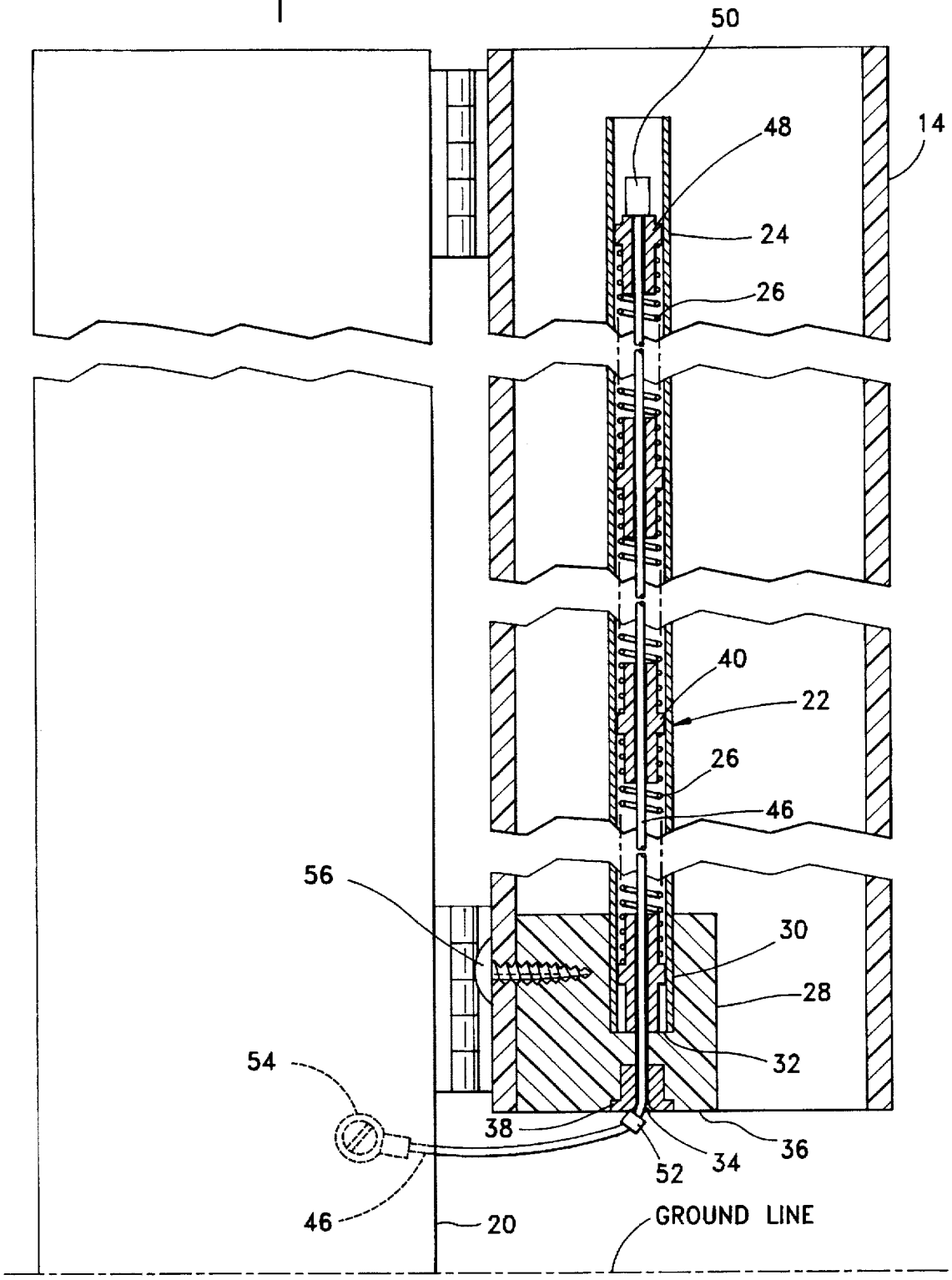
FIG. 4 is a perspective view, with parts broken away for ease of illustration and presentation, of the compression spring mechanism of this invention.

The self-closing compression spring mechanism 22 is illustrated, partially in section, in FIG. 4. Such mechanism comprises a cylindrical tube 24, such as a ½ inch diameter PVC tube, containing a plurality of compression springs 26, preferably three springs aligned end-to-end, therewithin. One end of the tube 24 is seated in a spring housing 28 having a stepped through channel 30, where the tube 24 rests against the annular shoulder 32. Around the channel opening 34, along the housing base 36, there may be provided a collar 38, formed of a wear resistant material, such as TEFLON, and configured to seat snugly within the channel 30, which as explained later, prevents scoring of the housing body by the action of a cable rubbing thereagainst.

Figure 5:
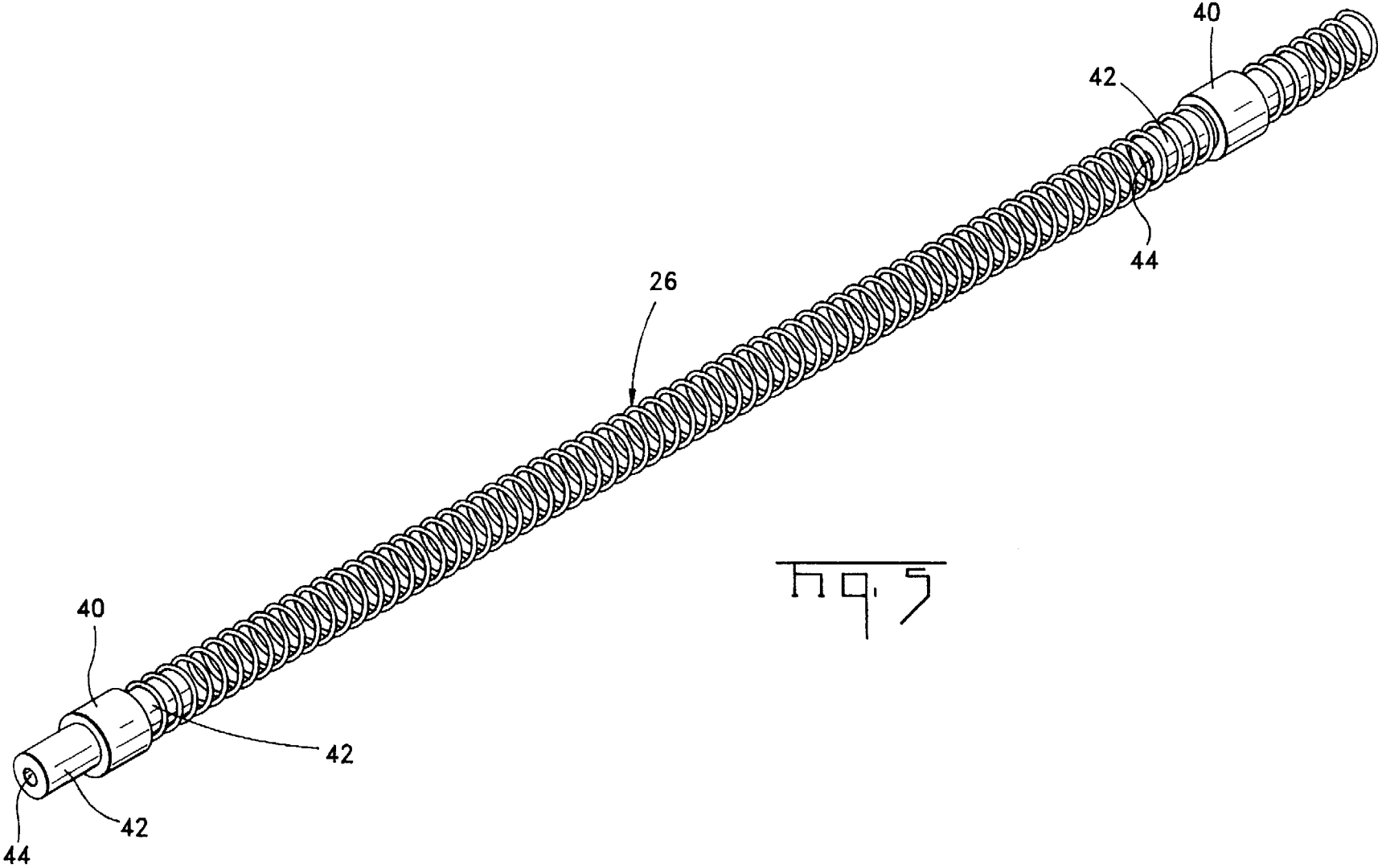
FIG. 5 is an enlarged perspective view of a single compression spring, with end spacer members ,where typically a plurality of such springs are used in the mechanism of FIG. 4.

FIG. 5 illustrates one of the compression springs 26 mounted within the tube 24. Adjacent such springs there is provided a spacer member 40 having reduced concentric ends 42 for receipt within a spring 26. Each spacer member 40 includes a central core opening 44 for slidably receiving the spring engaging cable 46, preferably formed of stainless steel or a high strength aluminum.

To assemble the closure mechanism 22, the cable 46 is fed into the channel 30, centrally up through the first spring 26, then the first spacer member 40, then in similar fashion through the remaining springs and spacer members, and finally into and through the end spacer member 48. The wire is secured thereto, such as by an end cap or clip 50. The wire is then pulled downwardly to create a first state of compression on each of the springs 26. As the springs are maintained in said first state of compression, a second end cap or clip 52 may be placed on the wire end, whereby to maintain the springs in a predetermined state of compression. This second end cap or clip 52 may take a variety of forms, but must be of a size to prevent the wire from being pulled up through the channel. With the mechanism so assembled, it may be positioned within the hollow gate post, and fastened therein by screw means 56, which post in turn is hingedly engaged with the adjacent stationary post 20. This predetermined state of compression represents the "closed" gate position.

To render the mechanism effective for closing a gate, a loop 54, provided at the free end of cable 46, is fixedly secured to the stationary post 20. As the gate is pivoted about said stationary post, the cable 46 is pulled through the channel 30, against the collar 38, which causes the respective springs 26 to be further compressed within the tube 24. As the gate is rotated further, more compression occurs on the respective springs, hence more energy is stored to effect closure when the gate is released. As the gate is released, the compressed springs begin to axially extend pulling the cable 46 up the tube and thus closing the gate.

For the preferred embodiment of the closure or compression spring mechanism 22 illustrated in FIGS. 4 and 5, the resiled or uncompressed spring of FIG. 5 is about nine (9) inches. However, when three such springs are positioned end-to-end within the tube, the approximate compressed length is about twenty four (24) inches. This represents the first state of compression for the springs—the state for the closed gate.

In developing the mechanism just described, it was discovered that multiple springs, preferably three aligned end-to-end in a ½ inch tube of about twenty eight (28) inches in length, were critical. With only a single spring, it was found that the spring upon compressing would bind against the inner wall of the tube, and not properly close the gate.

We claim:

1. In combination with a swinging gate capable of pivoting up to 180 degrees, where said gate includes a stationary post and a movable post that pivots thereabout, said movable post being hollow for receiving a compression spring mechanism therewithin, a compression spring mechanism comprising a cylindrical tube, a plurality of compression springs aligned end-to-end within said tube, a spring housing secured to one end of said tube for receiving an end of one of said compression springs, and a cable passing through said aligned compression springs and said spring housing and being secured to the end of said compression spring remote from said spring housing, whereby said compression springs are maintained in a first state of compression when said gate is closed, and a second state of compression when said gate is opened.

2. The combination according to claim 1, wherein said second state of compression is greater than said first state, and that said second state increases proportionally to the extent of the gate opening.

3. The combination according to claim 1, wherein said compression spring mechanism is slidably received within said hollow post and means are provided to secure said spring housing to said post.

4. The combination according to claim 1, wherein there are three compression springs having a spacer member between adjacent ends of said compression springs.

5. The combination according to claim 1, wherein the opposite end of said cable is secured to said stationary post.

6. The combination according to claim 5, wherein said spring housing includes a through channel aligned with said compression springs through which said cable exits to be secured to said stationary post.

7. The combination according to claim 6, wherein said spring housing includes an end face having an opening to said through channel, and said opening includes a wear resistant collar.

8. A compression spring mechanism suitable to effect movement of a pivotal member, such as a swinging gate, said mechanism comprising a cylindrical tube, a plurality of compression springs aligned end-to-end within said tube, a spring housing secured to one end of said tube for receiving an end of one of said compression springs, and a cable of predetermined length passing through said aligned compression springs and spring housing, one end of said cable secured to the end of said spring most remote from said spring housing, with the opposite end of said cable secured outside of and remote from said housing, whereby said springs are placed in a first state of compression prior to securing said opposite end.

9. The compression spring mechanism according to claim 8, wherein there are three compression springs having a spacer member between adjacent ends of said compression springs.

10. The compression spring mechanism according to claim 8, wherein said spring housing includes a through channel aligned with said compression springs through which said cable exits to expose said second end.

11. The compression spring mechanism according to claim 10, wherein said spring housing includes an end face having an opening to said through channel, and said opening includes a wear resistant collar.

* * * * *